US008113628B2

(12) United States Patent
Xie

(10) Patent No.: US 8,113,628 B2
(45) Date of Patent: Feb. 14, 2012

(54) INKJET PRINTERS HAVING MICRO-FLUIDIC ACTUATORS

(75) Inventor: Yonglin Xie, Pittsford, NY (US)

(73) Assignee: Eastman Kodak Company, Rochester, NY (US)

( * ) Notice: Subject to any disclaimer, the term of this patent is extended or adjusted under 35 U.S.C. 154(b) by 334 days.

(21) Appl. No.: 12/487,675

(22) Filed: Jun. 19, 2009

(65) Prior Publication Data

US 2010/0321444 A1 Dec. 23, 2010

(51) Int. Cl.
*B41J 2/04* (2006.01)

(52) U.S. Cl. ..... 347/54; 347/65

(58) Field of Classification Search ..... 347/20, 347/44, 47, 54, 56, 61–65, 67, 70–71, 68; 60/527–529; 310/306–307; 251/129.01, 251/129.02, 129.06; 337/139–141
See application file for complete search history.

(56) References Cited

U.S. PATENT DOCUMENTS 4,480,259 A * 10/1984 Kruger et al. ..... 347/63
5,767,612 A * 6/1998 Takeuchi et al. ..... 310/324
5,943,074 A * 8/1999 Kashino et al. ..... 347/54
6,749,407 B2 * 6/2004 Xie et al. ..... 417/413.2
6,811,133 B2 11/2004 Miles
2006/0232631 A1 10/2006 Silverbrook

OTHER PUBLICATIONS

Y. Xie, "A Micro-Fluidic Actuator for Inkjet Printers", U.S. Appl. No. 12/487,674, (D-95395) filed herewith.

* cited by examiner

*Primary Examiner* — Juanita D Jackson
(74) *Attorney, Agent, or Firm* — Peyton C. Watkins

(57) ABSTRACT

A printer includes (a) an ink reservoir containing ink and having an outlet through which the ink passes for ejection onto a print medium; (b) a micro-fluidic actuator having (i) an inlet channel through which fluid enters; (ii) a chamber through which the fluid is received from the inlet channel; (iii) an outlet channel that receives the fluid from the chamber and passes the fluid through the outlet channel so that a conduit pathway for the fluid is formed from the inlet channel, chamber and outlet channel; (iv) a flexible membrane that forms a portion of a shared wall between the chamber and the ink reservoir and that displaces in response to fluidic pressure; (v) at least a first valve in the conduit pathway which, when the valve is activated, causes flow of the fluid through the conduit pathway to be altered so that pressure of the fluid passing through the chamber changes which, in turn, causes the flexible membrane to displace which, in turn, causes the ink to be ejected or not ejected from the ink reservoir according to the displacement of the flexible membrane.

53 Claims, 18 Drawing Sheets

INKJET PRINTERS HAVING MICRO-FLUIDIC ACTUATORS

CROSS-REFERENCE TO RELATED APPLICATION

This application is filed concurrently with and has related subject matter to U.S. patent application Ser. No. 12/487,674, titled "A Micro-Fluidic Actuator for Inkjet Printers", with Yonglin Xie as the inventor.

FIELD OF THE INVENTION

The present invention generally relates to inkjet printer and more particularly to such inkjet printers having a micro-fluidic actuator with a flexible membrane that displaces ink from its ink reservoir according to the displacement of the flexible membrane.

BACKGROUND OF THE INVENTION

Currently, there are various mechanisms for ejecting ink from an ink reservoir. For example, US Patent Publication 2006/0232631 A1 discloses an ink reservoir having a piston in the ink reservoir which is movable to cause ink to be ejected from the reservoir. The piston is connected to a heating element that is energized that causes the heating element to expand which, in turn, causes the piston to move to eject the ink. Although pistons are satisfactory, improvements are always desirable. For example, heating elements usually require a high input voltage which is not desirable.

While not an ink ejecting system, U.S. Pat. No. 6,811,133 B2 discloses a hydraulic system having a primary movable membrane with a piezoelectric material and a secondary movable membrane. Fluid is disposed between the primary and secondary membrane, and the piezoelectric material of the primary membrane is energized for causing the primary membrane to bow which, in turn, causes the secondary membrane to bow. The bowing of the secondary membrane functions as a valve in which the valve is opened and closed according to movement of the secondary membrane. Consequently, valve structures of this type are not needed for inkjet printing devices to eject ink.

Existing thermal inkjet actuators (bubble jet) boils ink directly to produce vapor bubbles to eject liquid drops. Such devices have limited ink latitude (aqueous based inks only) and suffer from reliability problems related to kogation (solid deposits baked onto the surface of the heater surface) and heater failure due to repeated heating to high temperatures. Existing non-thermal inkjet actuators (piezo-actuator or electrostatic actuator) have much wider ink latitude (aqueous and non-aqueous based inks) as well as longer lifetime. However, such actuators have small (sub-micron) displacement; therefore, a large actuator area is needed to displace sufficient amount of liquid to produce desired drop volume. As a result, it is very difficult to achieve high nozzle density required for high-resolution printing. Also, high voltage or high current are needed to activate such inkjet actuators, which require expensive and complicated drive electronics and limit maximum operating frequency.

Consequently, a need exists for a non-thermal ink ejecting mechanism in which large actuator displacement can be achieved with low input voltage or energy.

SUMMARY OF THE INVENTION

The present invention is directed to overcoming one or more of the problems set forth above. Briefly summarized, according to one aspect of the invention, the invention resides in a printer comprising (a) an ink reservoir containing ink and having an outlet through which the ink passes for ejection onto a print medium; (b) a micro-fluidic actuator comprising: (i) an inlet channel through which fluid enters; (ii) a chamber through which the fluid is received from the inlet channel; (iii) an outlet channel that receives the fluid from the chamber and passes the fluid through the outlet channel so that a conduit pathway for the fluid is formed from the inlet channel, chamber and outlet channel; (iv) a flexible membrane that forms a portion of a shared wall between the chamber and the ink reservoir and that displaces in response to fluidic pressure; (v) at least a first valve in the conduit pathway which, when the valve is activated, causes flow of the fluid through the conduit pathway to be altered so that pressure of the fluid passing through the chamber changes which, in turn, causes the flexible membrane to displace which, in turn, causes the ink to be ejected or not ejected from the ink reservoir according to the displacement of the flexible membrane.

These and other objects, features, and advantages of the present invention will become apparent to those skilled in the art upon a reading of the following detailed description when taken in conjunction with the drawings wherein there is shown and described an illustrative embodiment of the invention.

BRIEF DESCRIPTION OF THE DRAWINGS

While the specification concludes with claims particularly pointing out and distinctly claiming the subject matter of the present invention, it is believed that the invention will be better understood from the following description when taken in conjunction with the accompanying drawings, wherein:

DETAILED DESCRIPTION OF THE INVENTION

Figure 1A:
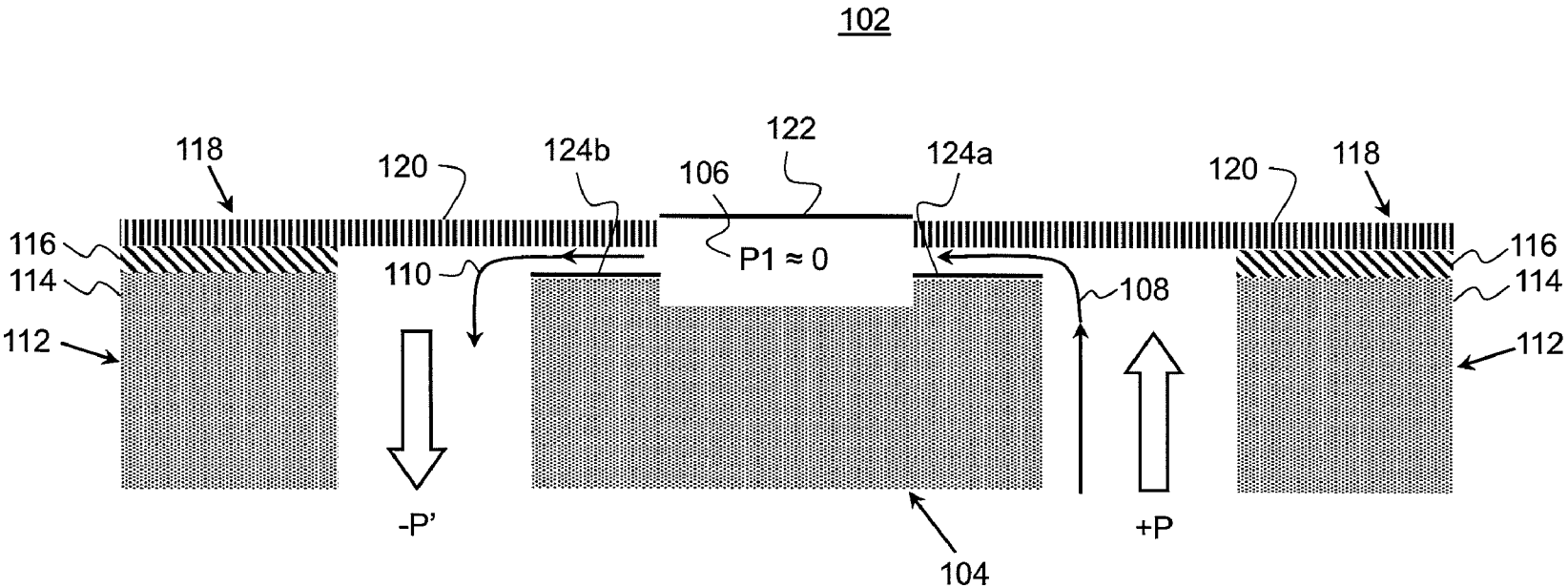
FIG. 1A is a side, cross-sectional view of the micro-fluidic actuator of the present invention having a pressure chamber for displacing a flexible membrane.

Referring to FIG. 1A, there is shown a side view in cross-section of the micro-fluidic actuator 102 of the present invention. It is noted that, in the drawings, the flow of fluid in the drawings is indicated by the enlarged arrow. The micro-fluidic actuator 102 includes a solid, box-shaped base member 104, preferably made of silicon, having a cut-away, upper portion that forms a pressure chamber 106. Fluid enters an inlet channel 108, passes into the chamber 106 and exits through an outlet channel 110. It is noted that a pressure source (not shown) provides a positive pressure +P on fluid at the inlet channel 108 and a vacuum source (not shown) provides a negative pressure −P' on fluid at the outlet channel 110, both of which apply the needed pressure and vacuum to the fluid to cause the fluid to circulate therethrough. The magnitudes of P and P' can be chosen to be the same, or they can be chosen to be different. The fluid is preferably either water, or a low boiling point fluid such as ethanol, methanol, or 3M Fluorinert® liquid.

The actuator 102 includes side walls 112 having a first side portion 114, preferably made of silicon, and a second side portion 116, preferably made of oxide or a polymer, joined together. Together the first and second portions 114 and 116 completely surround the base member 104 so that the fluid is contained therein. A top-enclosure 118 forms a covering of the actuator 102 and includes an inflexible member 120, preferably made of a dielectric, disposed on the outer portion of the actuator 102 and attached to the side walls 112. The top enclosure 118 includes a flexible member (referred to herein interchangeably as a membrane), preferably made of a dielectric, which spans and covers the chamber 106 and forms a top wall for the chamber 106. For clarity of understanding, it is noted that a conduit pathway for the fluid is formed from the inlet channel 108, chamber 106 and outlet channel 110.

It is noted that the flexible membrane 122 may be made of a number of different materials. For example, the flexible membrane 122 may be a dielectric such as silicon nitride, silicon oxide or silicon carbide. The flexible membrane may also be a polymer such as polymide. The flexible membrane 122 may also be a silicon, metal, or metal alloy. The above list is a representative list of materials and is not intended to limit the scope of the invention.

Two MEMS (micro-electro-mechanical system) valves 124*a* and *b* are disposed respectively in the inlet channel 108 and outlet channel 110 and are preferably made of a metal bi-morph (i.e. a thermal actuator valve) or a piezoelectric material. The valves 124*a* and 124*b* may also be made of metal tri-morph, an electrostatic actuator or a heater that boils the liquid to form a vapor bubble to modulate the flow passing through the inlet channel 108 or the outlet channel 110 where the particular valve 124*a* or 124*b* is located. The valve 124*a* in the inlet channel 108 will be called an inlet valve 124*a* and the valve 124*b* in the outlet channel 110 will be called an outlet valve 124*b*. Both valves 124*a* and 124*b* are actuated by any suitable means (not shown) suitable to operate the valves such as a voltage supply or the like. Fluid enters the inlet channel 108, and when both valves 124*a* and 124*b* are open (not actuated), fluid flows freely through the chamber 106 and out of the outlet channel 110. In this mode, the chamber pressure P1 is substantially equal to zero, so that the flexible membrane 122 is not displaced.

Figure 1B:
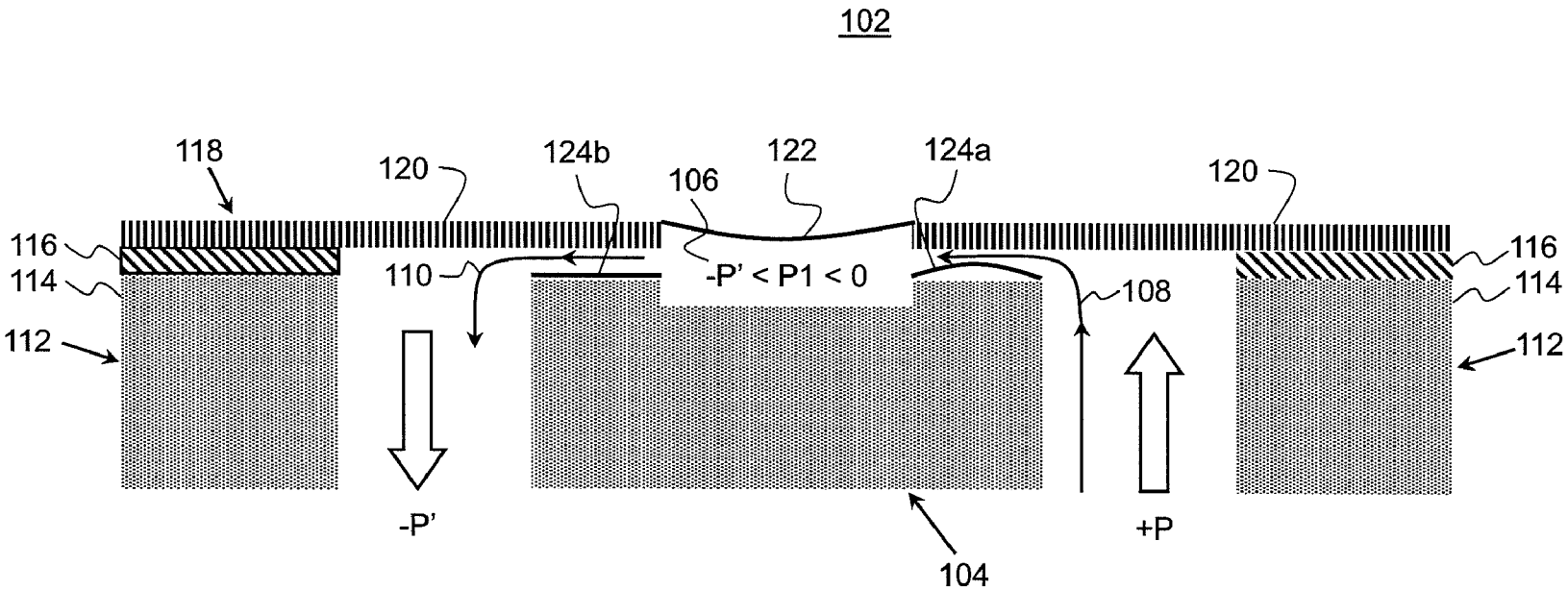
FIG. 1B illustrates FIG. 1A in which the inlet valve is partially closed and the flexible membrane is partially retracted inwardly.
Figure 1C:
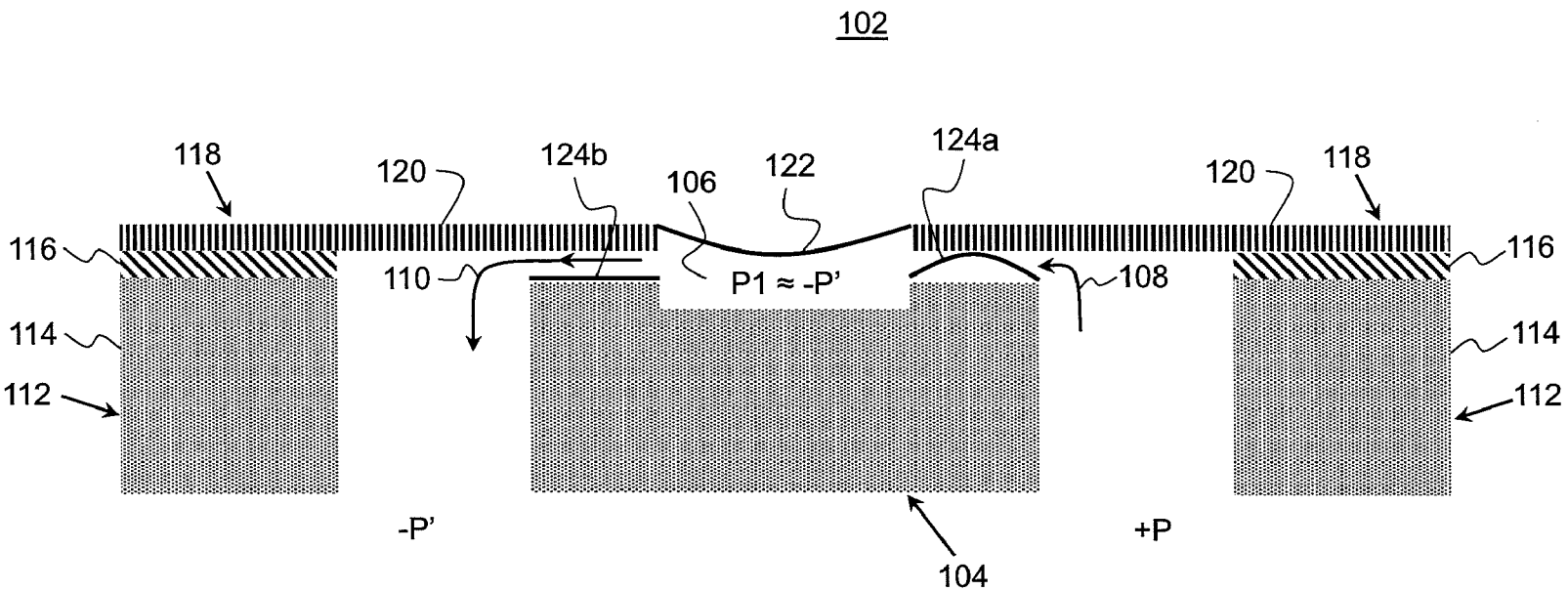
FIG. 1C illustrates FIG. 1A in which the inlet valve is fully closed and the flexible membrane is retracted to its maximum capacity inwardly.

Referring to FIG. 1B, the fluid enters the inlet channel 108, and when the inlet valve 124*a* is partially actuated so that flow of the fluid through the inlet channel 108 is partially obstructed and the outlet valve 124*b* is not actuated (the outlet channel is unobstructed), the chamber pressure P1 decreases so that the membrane 122 is displaced inwardly toward the interior of the chamber 106. The chamber pressure P1 in FIG. 1B is less than zero, but less negative than −P' which causes the flexible member 122 to displace inwardly. Referring to FIG. 1C, when the inlet valve 124*a* is fully actuated to completely obstruct or stop the flow of the fluid through the fluid the inlet channel 108 and the outlet valve 124*b* is not actuated (the outlet channel is unobstructed), the pressure in the chamber 106 decreases further to be approximately equal to −P', so that the flexible member 122 is displaced inwardly to an even greater extent (i.e., maximum capacity) than when the flow is partially obstructed.

Figure 1D:
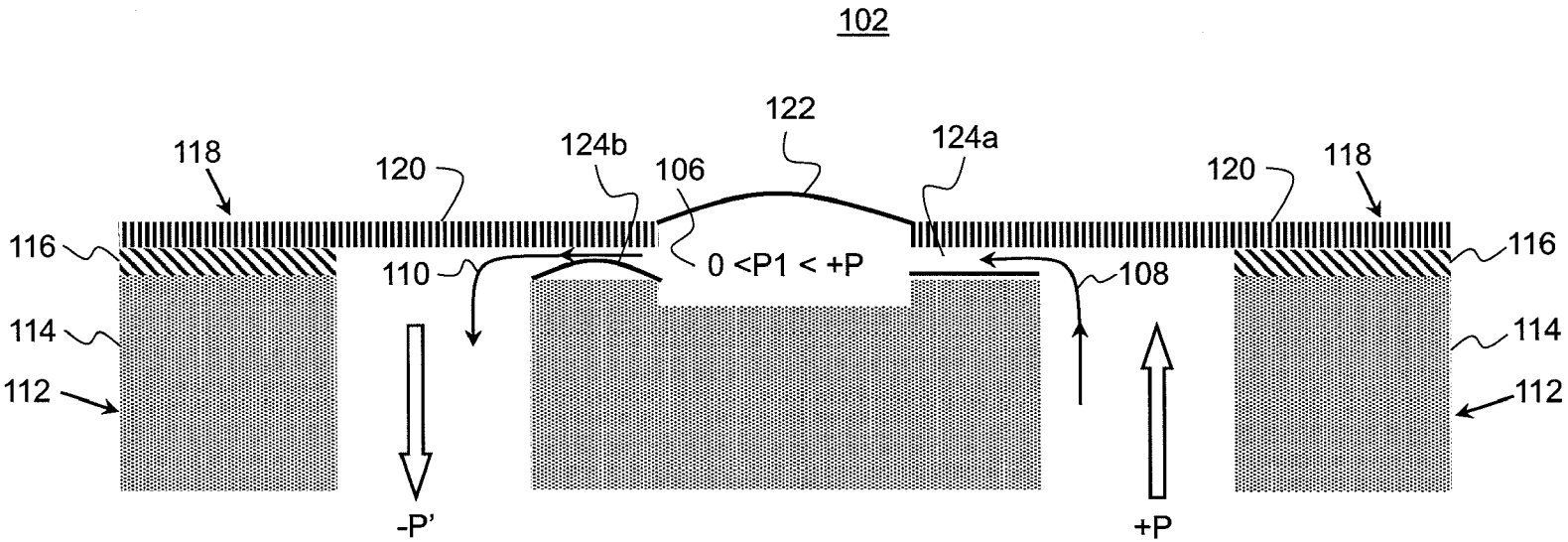
FIG. 1D illustrates FIG. 1A in which the outlet valve is partially closed and the flexible membrane is partially expanded outwardly.

Referring to FIG. 1D, when the outlet valve 124*b* is partially actuated to partially obstruct the flow of the fluid through the outlet channel 110 and the inlet valve 124*a* is not actuated, the pressure P1 in the chamber increases to greater than zero, but less than +P, so that the membrane 122 is displaced outwardly from the interior of the chamber 106. The fluid enters through the inlet chamber 108, passes into the chamber 106, increases pressure P1 in the chamber 106 due to the partially obstructed outlet channel 110 (thereby displacing the membrane 122) and exits through the outlet channel 110. As noted in FIG. 1E, when the outlet valve 124*b* is fully actuated to completely obstruct the flow of the fluid through the outlet channel 110 and the inlet valve 124*a* is open, the pressure in the chamber 106 increases to approximately +P, so that the flexible member 122 is displaced outwardly from the interior of the chamber 106 to an even greater extent (i.e., maximum capacity) than when the outlet channel 110 is partially obstructed as in FIG. 1D.

For a given pressure P1 in the chamber 106, the amount of membrane displacement also depends on other factors such as the membrane physical properties and dimensions. All things equal, a membrane 122 with lower elastic modulus produces larger displacement. All things equal, a membrane 122 with less thickness, such as less than 10 microns, produces larger displacement. In addition, membrane thickness that is small compared to the lateral dimensions of the membrane is better for larger displacement. For example, a membrane thickness that is less than ⅕ of the minimum width of the membrane is better for larger displacement. All things equal, a membrane 122 with larger area produces larger displacement provided the aspect ratio of the membrane 122 is the same.

As will be discussed in detail hereinbelow, displacement of the membrane 122 inwardly and outwardly is beneficial when used in printing devices such as inkjet printing devices to eject ink. Although an inkjet printing device is used as an illustrative embodiment, the micro-fluidic actuator 102 of the present invention may be used on any suitable printing device or fluid handling device.

Figure 1E:
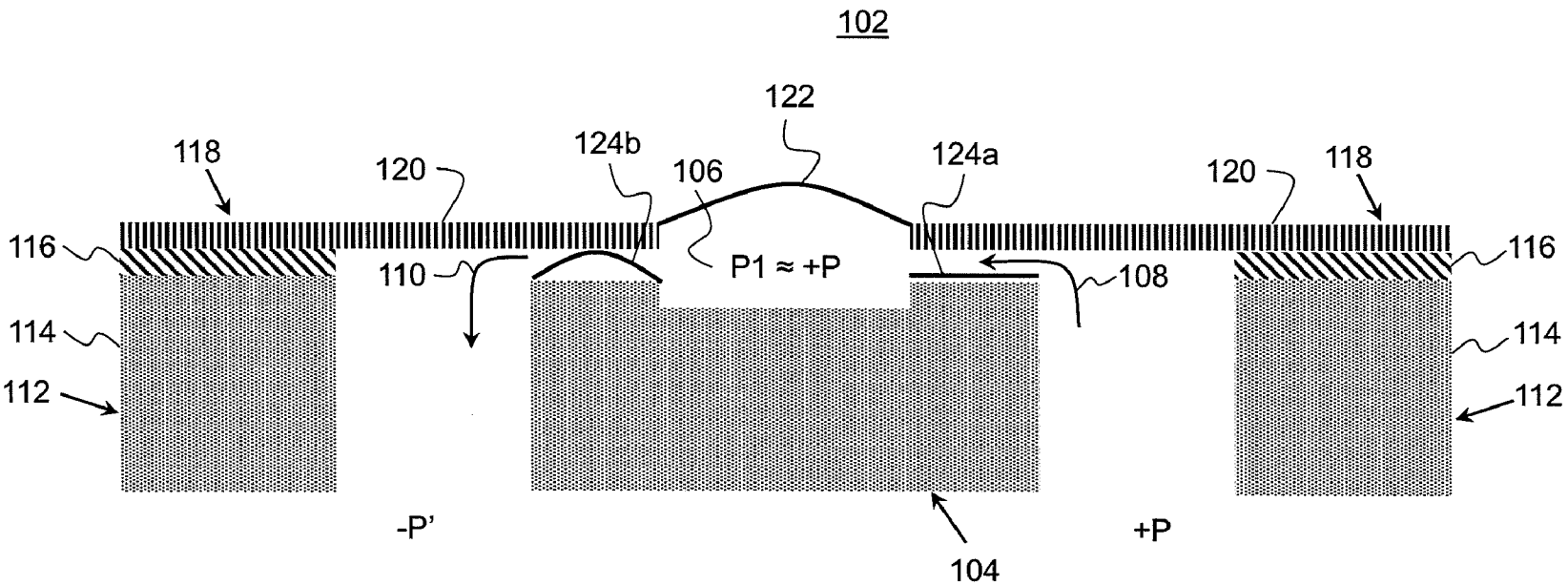
FIG. 1E illustrates FIG. 1A in which the outlet valve is fully closed and the flexible membrane is expanded to its maximum capacity outwardly.
Figure 2:
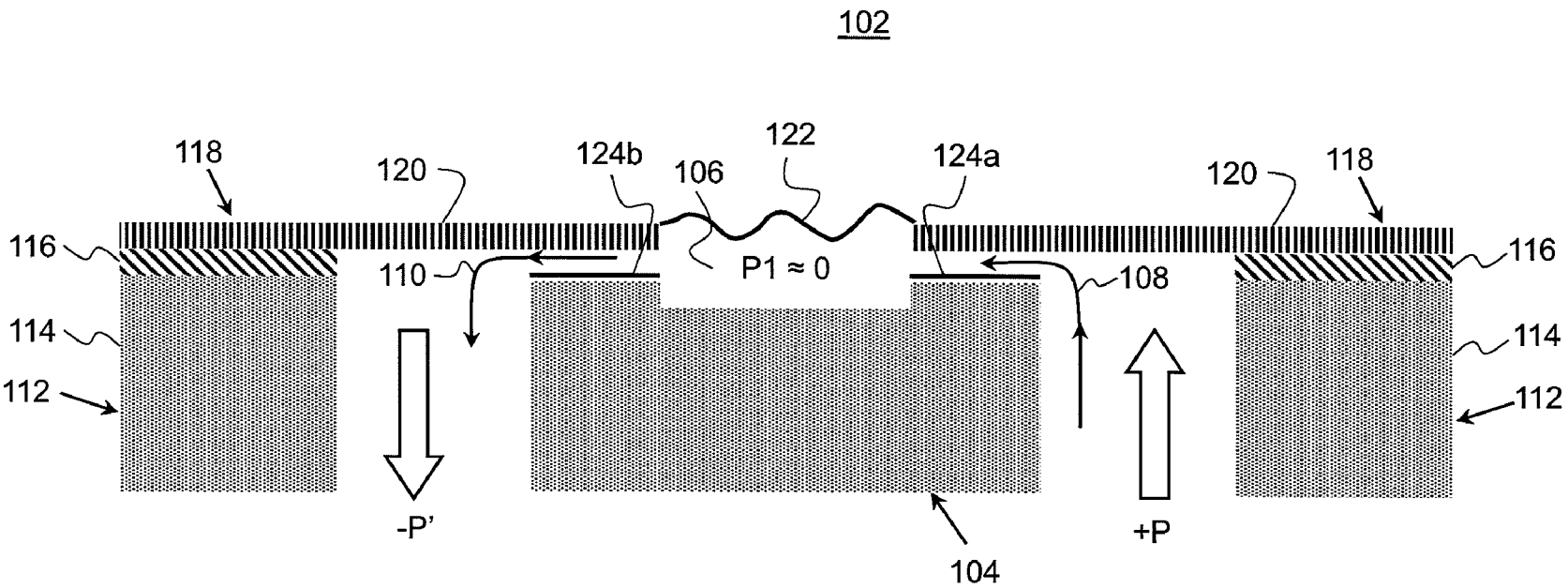
FIG. 2 illustrates FIG. 1A in which the flexible membrane is corrugated.

Referring to FIG. 2, there is shown an alternative embodiment of the present invention. The micro-fluidic actuator 102 includes a corrugated, flexible membrane 122 which permits higher displacement of the membrane 122 than the embodiment of FIGS. 1A-1E. By being corrugated, the flexible membrane 122 is inherently longer than the opening over the chamber 106 over which it spans and covers. This permits the membrane 122 to have greater displacement. For thoroughness, it is noted that the operation of the valves 124*a* and 124*b* displaces the membrane 122 the same as described in FIGS. 1A-1E.

Figure 3A:
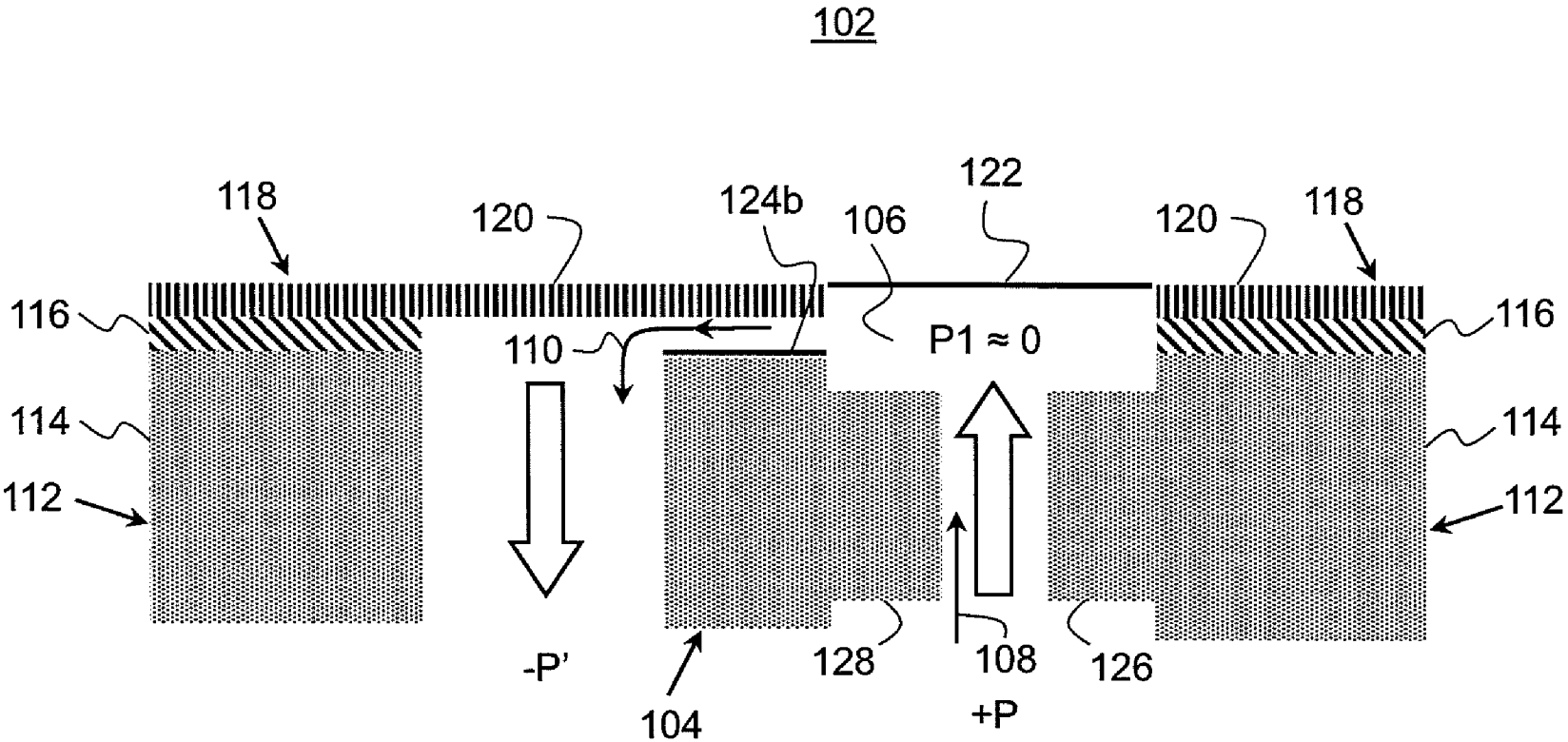
FIG. 3A is an alternative embodiment of the micro-fluidic actuator of the present invention.
Figure 3B:
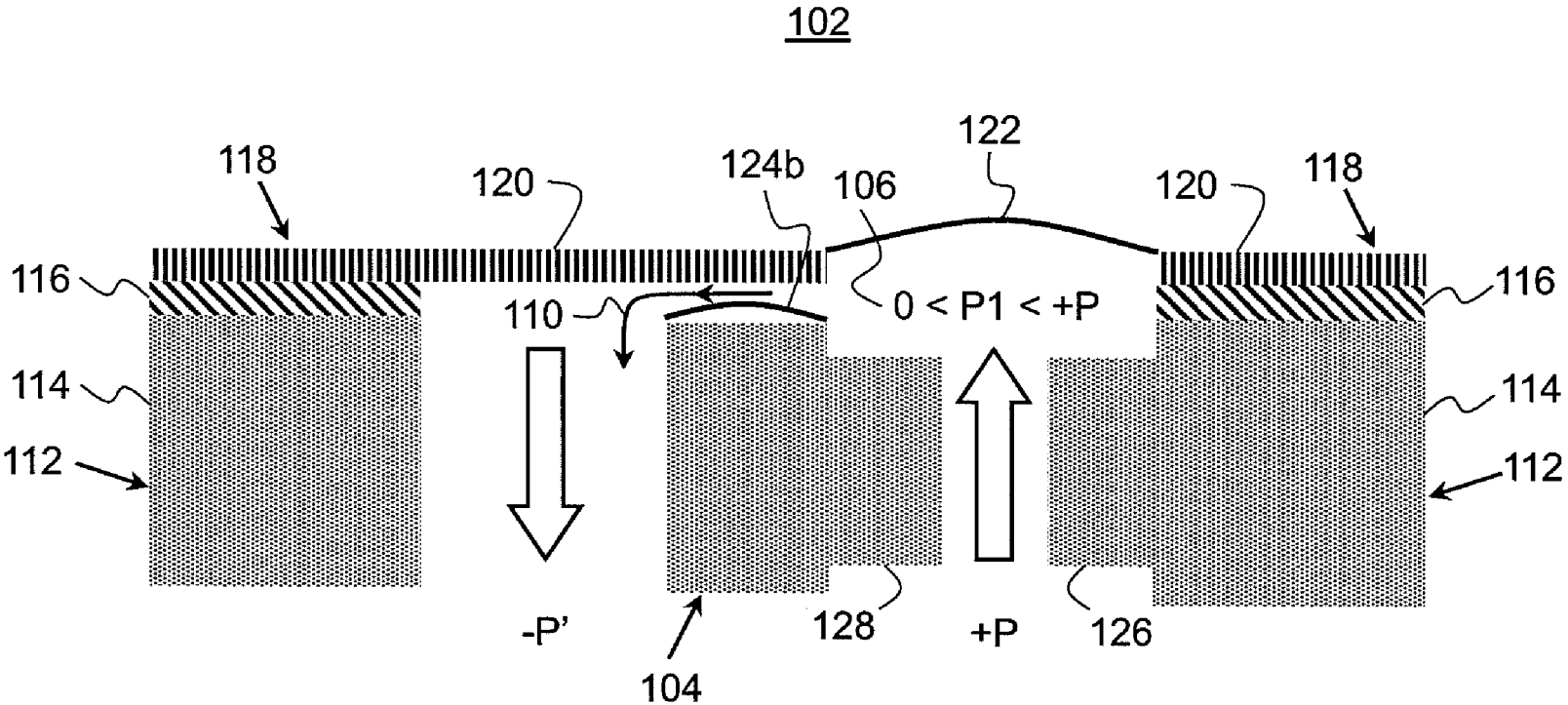
FIG. 3B illustrates FIG. 3A in which the outlet valve is partially closed and the flexible membrane is partially expanded outwardly.
Figure 3C:
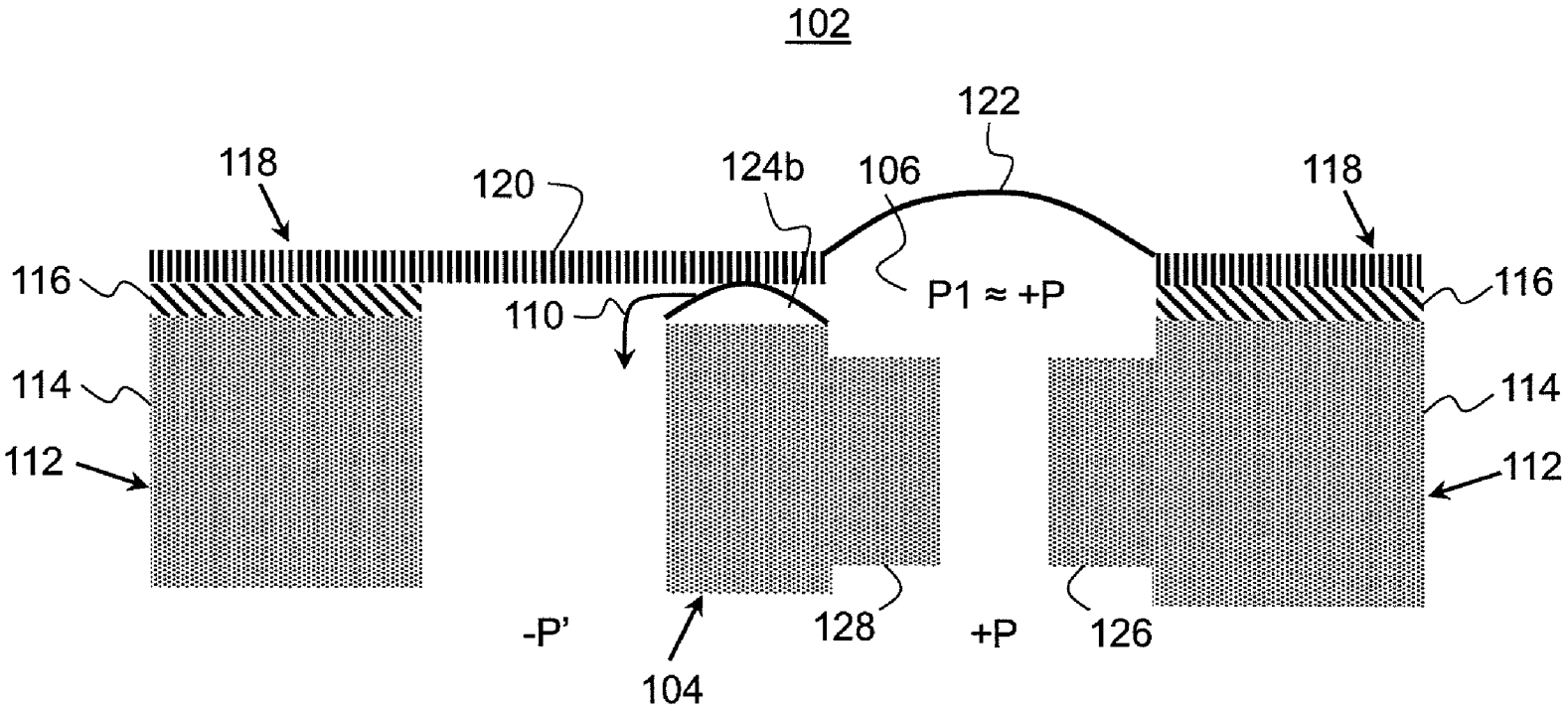
FIG. 3C illustrates FIG. 3A in which the outlet valve is fully closed and the flexible membrane is extended outwardly to its maximum capacity.

Referring to FIGS. 3A-3C, there is shown another alternative embodiment of the present invention. In this embodiment, a portion of the side wall 112 includes a protruding portion 126 which forms a portion of the chamber 106, and the base member 104 includes a protruding portion 128 which forms the other portion of the chamber 106. The flexible membrane 122 extends spanning the chamber 106 and the inlet channel 108 is disposed between the protruding portion 128 of the base member 104 and the protruding portion 126 of the side walls 126. A MEMS outlet valve 124*b* is positioned in the outlet channel 110 on the base member 104, and the outlet channel 110 is disposed between the base member 104 and the opposite side wall 112. Fluid enters the inlet channel 108 and into the pressure chamber 106, and when the outlet valve 124*b* is not actuated, the pressure P1 in the pressure chamber 106 is approximately equal to zero, so that the flexible membrane 122 is not displaced but is in a non-flexed position or state. The fluid then exits the outlet channel 110. Referring to FIG. 3B, however, when the outlet valve 124*b* is partially actuated to partially obstruct the flow of the fluid through the outlet channel 110, the pressure P1 in the pressure chamber 106 is greater than 0 but less than +P, so that the flexible membrane 122 is displaced outwardly away from the interior of the chamber 106. Referring to FIG. 3C, when the outlet valve 124*b* is completely closed to completely stop or obstruct the flow of the fluid through the outlet channel 110, the pressure P1 in the pressure chamber increases further to approximately +P, so that the flexible member 122 is displaced outwardly from the interior of the pressure chamber 106 to an even greater extent (i.e., maximum capacity) than when the outlet valve 124*b* is partially closed.

Figure 3D:
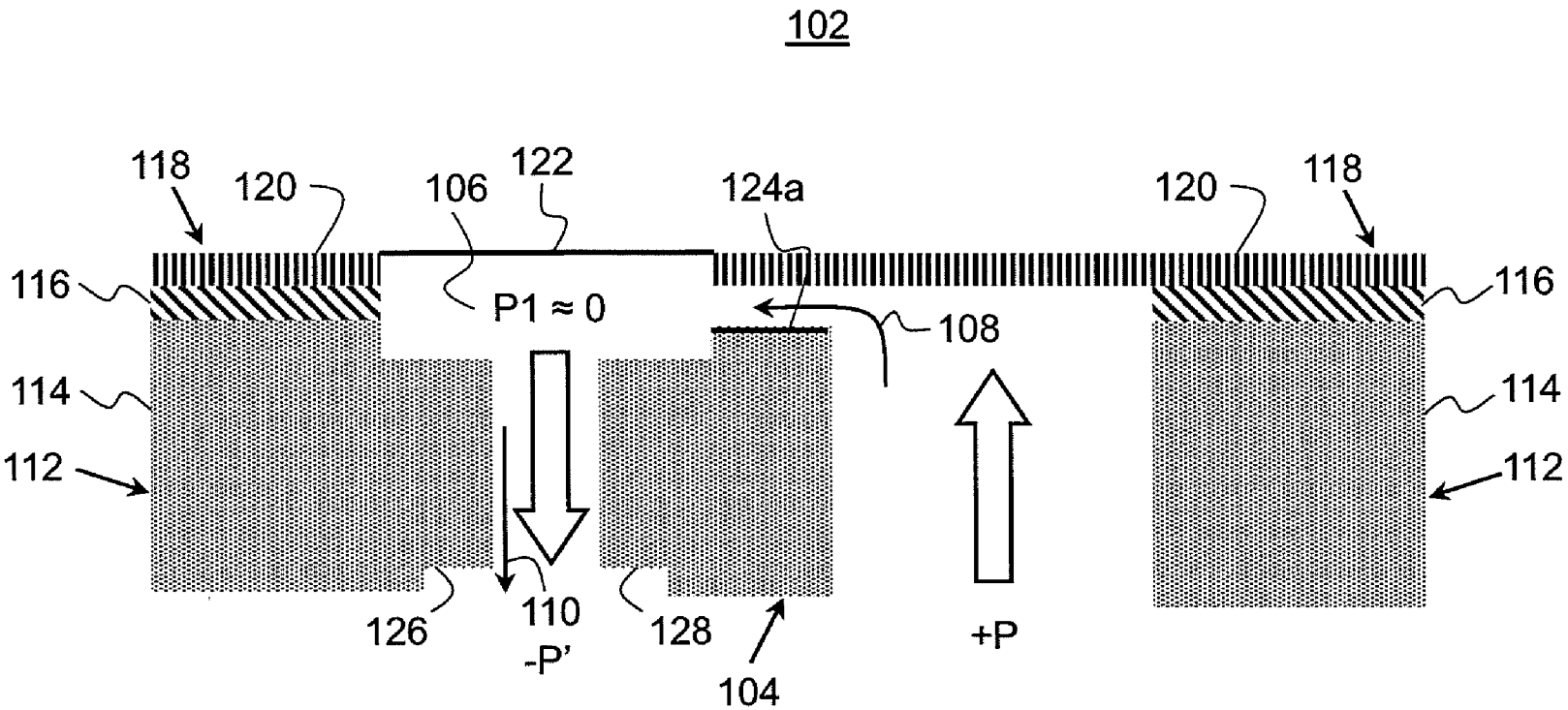
FIG. 3D is a third embodiment of the micro-fluidic actuator of the present invention.
Figure 3E:
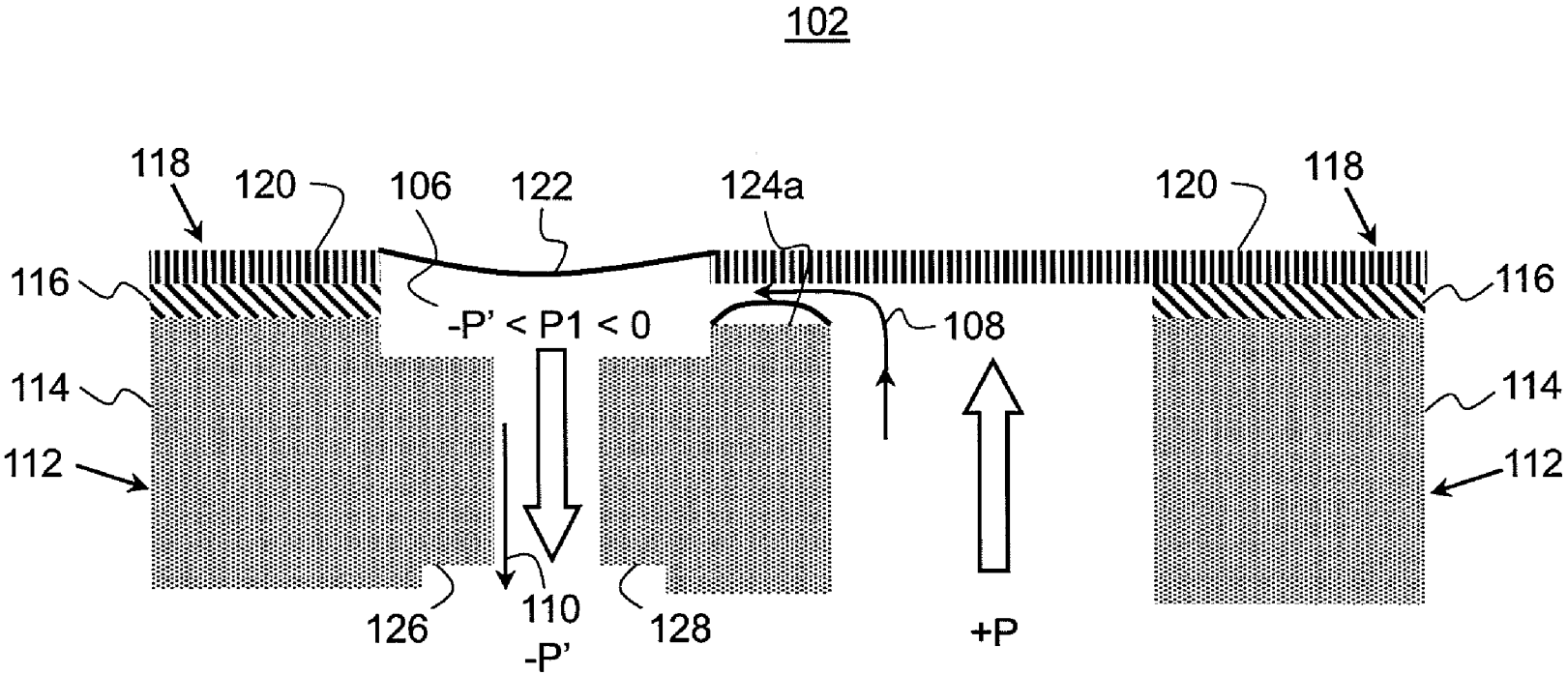
FIG. 3E illustrates FIG. 3D in which the inlet valve is partially closed and the flexible membrane is partially retracted inwardly.
Figure 3F:
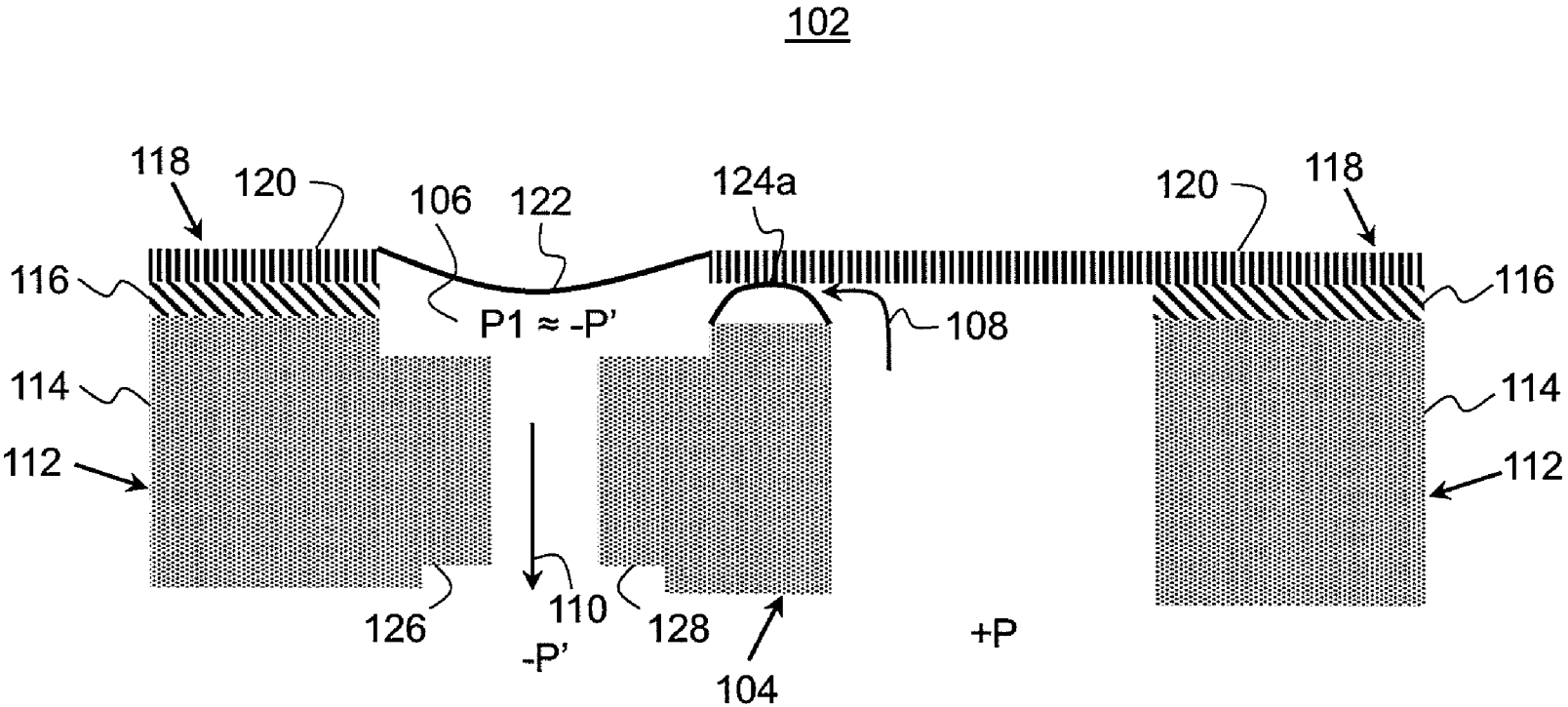
FIG. 3F illustrates FIG. 1A in which the inlet valve is fully closed and the flexible membrane is retracted inwardly to its maximum capacity.

Referring to FIGS. 3D-3F, there is shown yet another alternative embodiment of the present invention. In this embodiment, a portion of an opposite side wall 112 includes a protruding portion 126 which forms a portion of the chamber 106, and an opposite portion of the base member 104 includes a protruding portion 128 which forms the other portion of the chamber 106. The flexible membrane 122 extends spanning the chamber 106 and the outlet channel 110 is disposed between the protruding portion 128 of the base member 104 and the protruding portion 126 of the side wall 112. An inlet valve 124*a* is positioned in the inlet channel on the base member, and the inlet channel 108 is disposed between the base member 104 and the side wall 112 and across the inlet valve 124*a*. Fluid passes into the inlet channel 108, passes through the pressure chamber 106 and exits the outlet channel 110. When the inlet valve 124*a* is not actuated, the fluid flows unobstructed and the pressure P1 in the pressure chamber 106 is approximately equal to zero. The flexible membrane 122 is not displaced but is in a non-flexed position or state. Referring to FIG. 3E, when the inlet valve 124*a* is partially actuated to partially obstruct the flow of the fluid through the inlet channel 108, the pressure P1 in the pressure chamber 106 is less than zero, but is greater than −P', so that the flexible membrane 122 is displaced inwardly toward the interior of the pressure chamber 106. Referring to FIG. 3F, when the inlet valve 124*a* is fully actuated to completely obstruct the flow of the fluid through the inlet channel 108, the chamber pressure 106 becomes approximately −P', so that the flexible membrane 122 is displaced to an even greater extent (i.e, maximum capacity) than when the inlet channel 108 is partially obstructed.

Figure 4A:
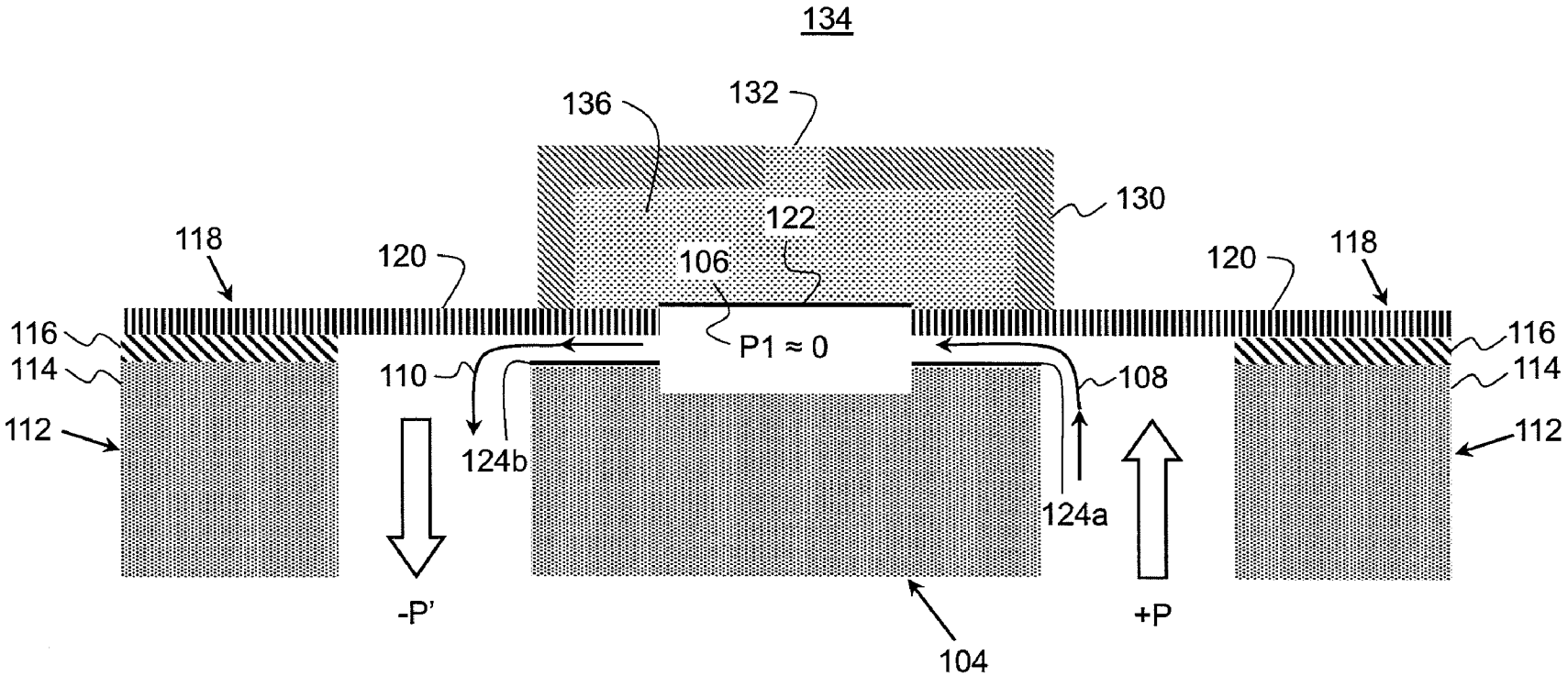
FIG. 4A illustrates the micro-fluidic actuator of FIG. 1A having an inkjet reservoir.
Figure 4B:
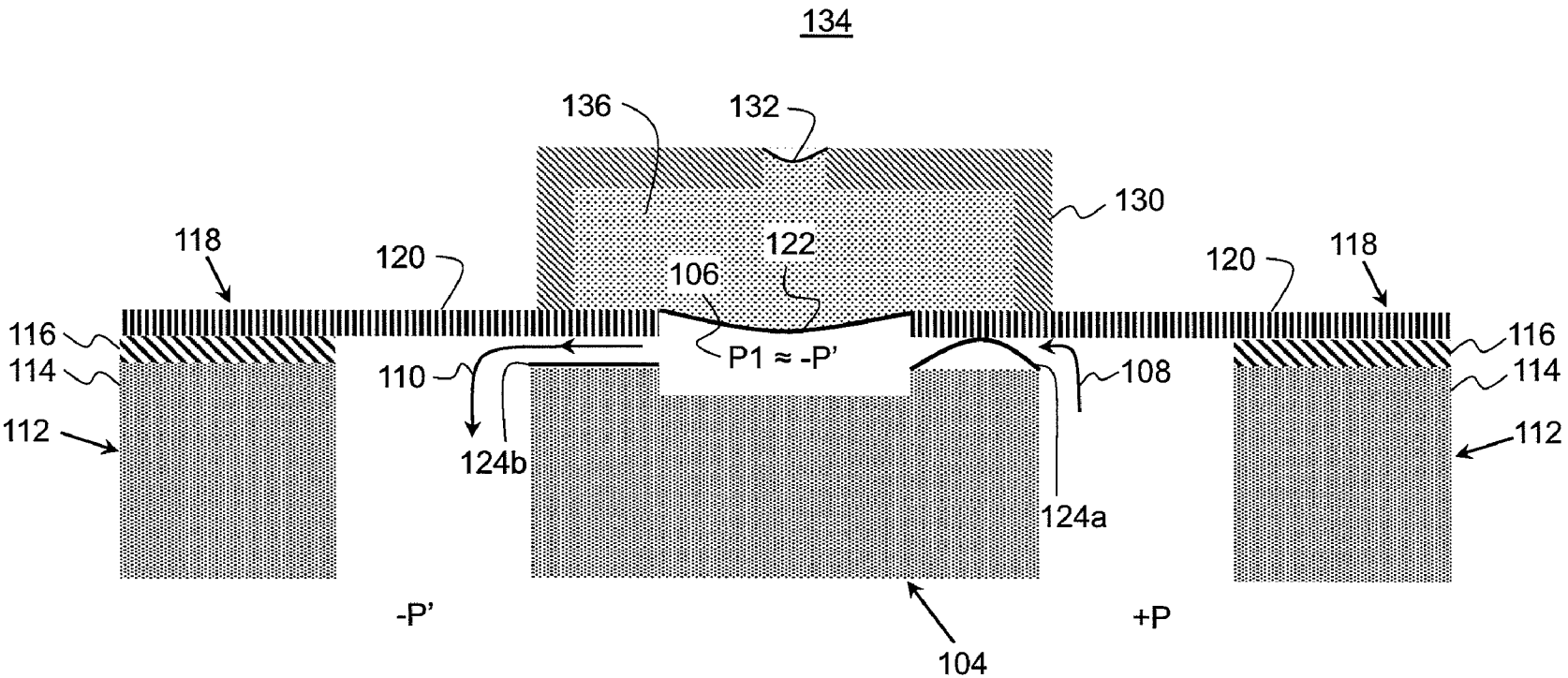
FIG. 4B illustrates FIG. 4A in which ink is retracted into the ink reservoir.
Figure 4C:
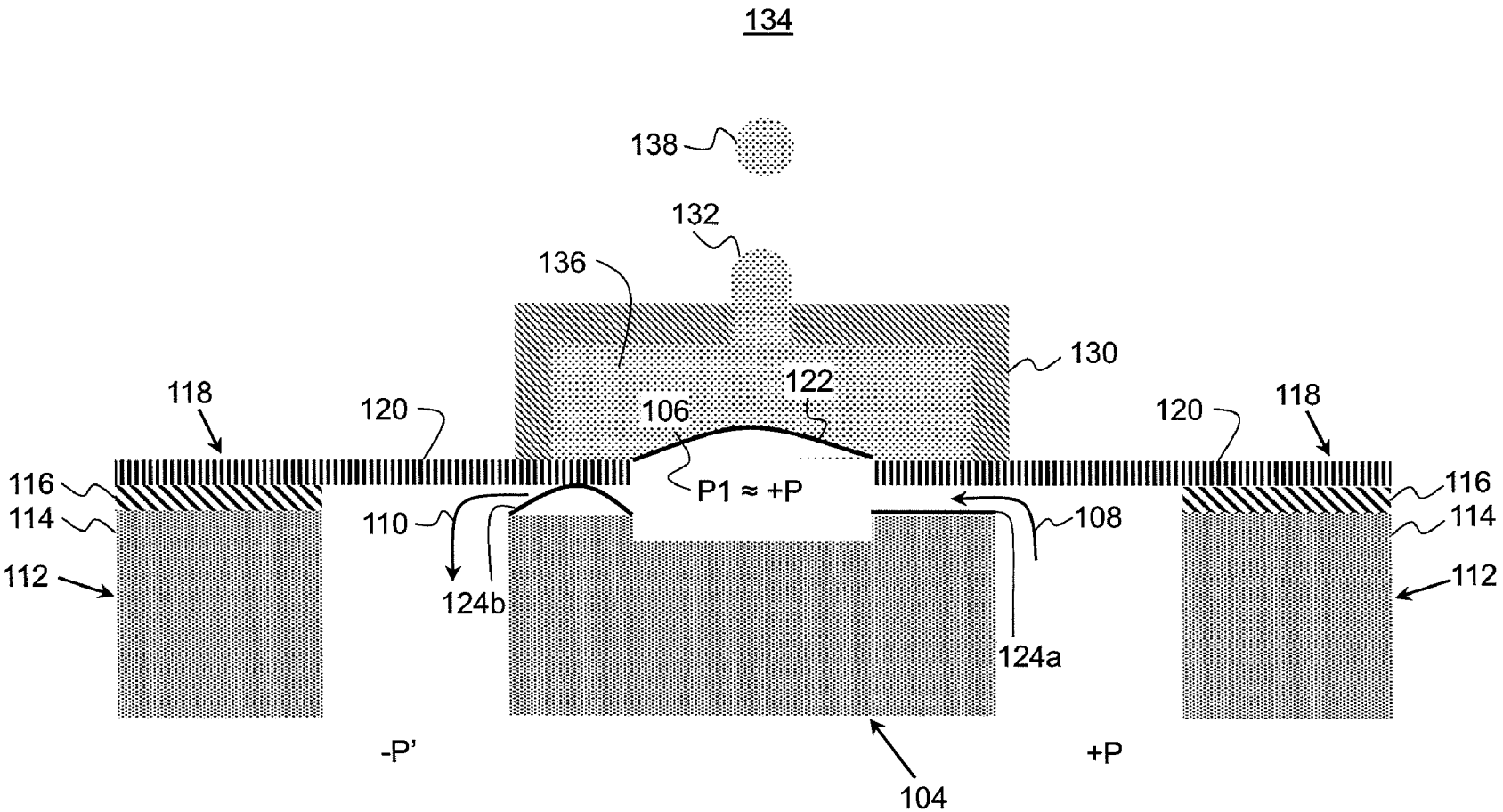
FIG. 4C illustrates FIG. 4A in which ink is ejected from the ink reservoir.

Referring to FIG. 4A, the embodiment of FIG. 1A is shown in an inkjet environment in which all the components of FIG. 1A are shown integrated with an inkjet reservoir 130 and a nozzle 132. The flexible member 122 is located on a portion of a shared wall between the chamber and the reservoir. The micro-fluidic actuator 102 integrated with its inkjet reservoir 130 and a nozzle 132 is hereinafter referred to as a microfluidic drop ejector 134. The reservoir 130 includes ink 136, which is either ejected from the reservoir 130, not ejected from the reservoir 130 or further retracted into the reservoir 130 according to the pressure applied by the flexible member 122. As shown in FIG. 4A, with both the inlet valve 124*a* and the outlet valve 124*b* open, the pressure P1 in the pressure chamber 106 is approximately equal to zero so that the flexible membrane 122 is not displaced (as described relative to FIG. 1A) but is in its normal, non-flexed position and ink 136 is not ejected from the reservoir 130. Referring to FIG. 4B, when the inlet valve 124*a* is fully closed and the outlet valve 125*b* is open so that the pressure P1 in the pressure chamber 106 is approximately equal to −P' and the flexible membrane 122 is displaced inwardly toward the interior of the pressure chamber 106 (as described relative to FIG. 1C), ink 136 is retracted back into the ink reservoir 130. Referring to FIG. 4C, when the outlet valve 124*b* is fully closed and the inlet valve 124*a* is open so that the pressure P1 in the pressure chamber 106 is approximately equal to +P and the flexible membrane 122 is displaced outwardly (as described in FIG. 1E), an ink droplet 138 is ejected from the ink reservoir 130.

The above paragraph describes the inkjet environment relative to the embodiment of FIGS. 1A-1E with the membrane positions of FIGS. 1A, 1C and 1E; however, it is understood that each of the embodiments of FIGS. 1A though 3F work similarly with the ink reservoir 130. When the flexible membrane 122 is displaced inwardly toward the interior of the pressure chamber 106, ink 136 is retracted into the ink reservoir 130. When the flexible membrane 122 is in its normal, non-displaced state, the ink 136 is not displaced in either direction and the ink level is unchanged. The more the displacement of the flexible membrane 122 outwardly from the reservoir 130; the more the ink 136 protrudes from the nozzle 132. When the membrane 122 is sufficiently displaced outwardly, a droplet of ink 128 breaks off and is ejected from the ink reservoir 130. As should be apparent to those skilled in the art, ink 136 is ejected from the reservoir 130 according to the displacement of the flexible membrane 122—the more the displacement of the flexible membrane 122 outwardly from the reservoir 130; the larger the drop volume is ejected. Variable drop volume can be achieved when the inlet valve 124*a* and the outlet valve 124*b* have multiple actuation states as shown in FIG. 1A through 1E. The ability to produce variable drop volume is beneficial to produce high quality print images by enabling more colors and higher levels of grey gradations.

In the above discussion of types of valves 124*a* and 124*b* (relative to FIG. 1) several types of valve were mentioned, including a metal bi-morph, a metal tri-morph, a thermal actuator, an electrostatic actuator, a piezoelectric actuator, or a heater that boils the liquid to form a bubble to modulate the flow passing through the inlet channel 108 or the outlet channel 110. Several of these types of valves are heat-actuated. For some embodiments of microfluidic drop ejector 134, and particularly for embodiments that involve boiling a fluid to actuate the valve, the fluid flowing from inlet channel 108 to outlet channel 110 is preferably chosen to be a different fluid than ink 136. In particular this fluid can be chosen to have a lower boiling point than that of the ink. In this way the valves 124*a* and 124*b* can be operated at lower energy than if they were in direct contact with ink 136. In addition, less heat is dissipated near the valves in this case, so that ink does not kogate on or near the valve. Some examples of fluids having a low boiling point relative to the boiling point of water-based inks include ethanol (boiling point 78° C.), methanol (boiling point 65° C.) and 3M Fluorinert® liquids (boiling point adjustable to as low as 30° C.).

Typically a plurality of micro-fluidic drop ejectors 134 (for example, one hundred or more) are formed together as an array of micro-fluidic drop ejectors 134 on a printhead die. Because the portion of the micro-fluidic drop ejector 134 that is seen externally is the nozzle 132, an array of micro-fluidic drop ejectors 134 is sometimes interchangeably referred to herein as a nozzle array (referred to as nozzle array 253 hereinbelow).

Figure 5:
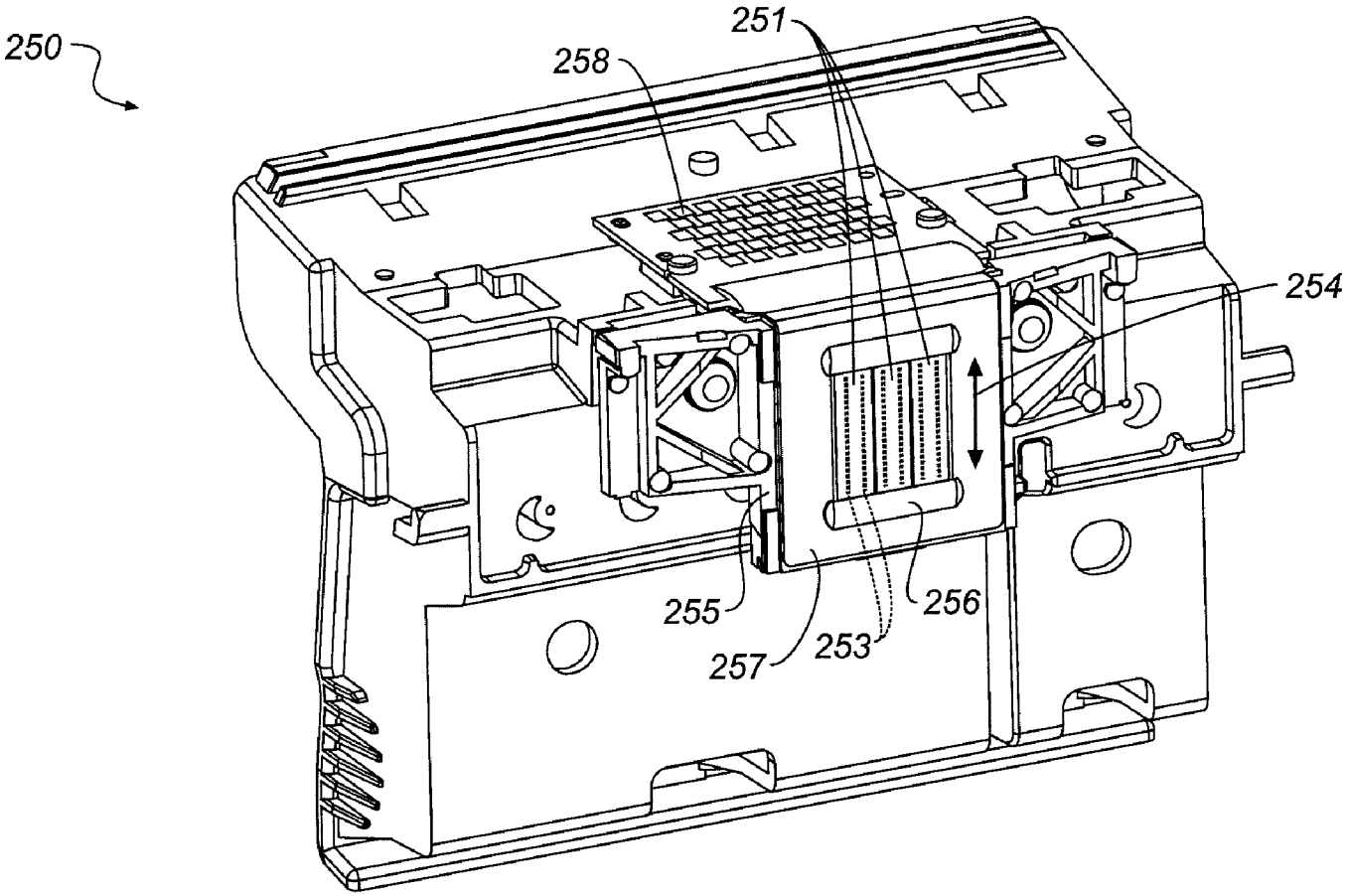
FIG. 5 is a printhead chassis of an inkjet printer of the present invention.

Referring to FIG. 5 a perspective view of a portion of a printhead chassis 250 for use in an inkjet printer is shown. Although an inkjet printhead is shown, any suitable printhead may be used. Printhead chassis 250 includes two printhead die 251 that are affixed to a common mounting support member 255. A printhead die 251 is an example of a printing device. Each printhead die 251 contains two nozzle arrays 253, such as two arrays of micro-fluidic drop ejectors, so that printhead chassis 250 contains four nozzle arrays 253 (four arrays of micro-fluidic drop ejectors) altogether. The four nozzle arrays 253 in this example can each be connected to separate ink sources such as cyan, magenta, yellow, and black. Each of the four nozzle arrays 253 is disposed along nozzle array direction 254, and the length of each nozzle array along nozzle array direction 254 is typically on the order of 1 inch or less. Typical lengths of recording media are 6 inches for photographic prints (4 inches by 6 inches) or 11 inches for paper (8.5 by 11 inches). Thus, in order to print a full image, a number of swaths are successively printed while moving printhead chassis 250 across a recording medium 370 (see FIG. 7). Following the printing of a swath, a recording medium 370 is advanced along a media advance direction that is substantially parallel to nozzle array direction 254.

Also shown in FIG. 5 is a flex circuit 257 to which the printhead die 251 are electrically interconnected, for example, by wire bonding or TAB bonding. The interconnections and interconnection pads (not shown) are covered by an encapsulant 256 to protect them. Flex circuit 257 bends around the side of printhead chassis 250 and connects to connector board 258. When printhead chassis 250 is mounted into the carriage 200 (see FIG. 6), connector board 258 is electrically connected to a connector (not shown) on the carriage 200, so that electrical signals can be transmitted to the printhead die 251.

Figure 6:
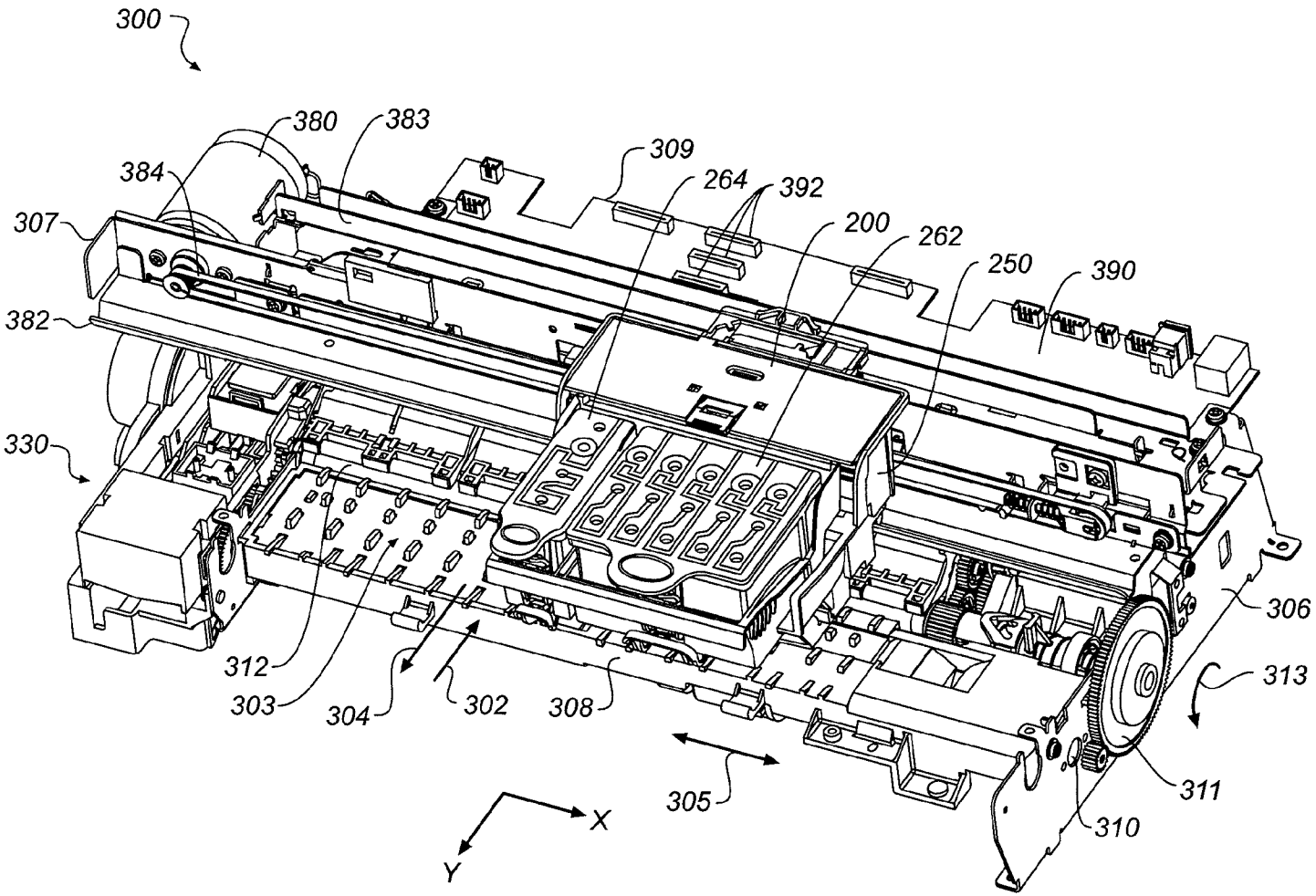
FIG. 6 is a perspective view of a portion of a desktop carriage printer of the present invention.

FIG. 6 shows a portion of a desktop carriage printer. Some of the parts of the printer have been hidden in the view shown in FIG. 6 so that other parts can be more clearly seen. Printer chassis 300 has a print region 303 across which carriage 200 is moved back and forth in carriage scan direction 305 along the X axis, between the right side 306 and the left side 307 of printer chassis 300, while drops are ejected from printhead die 251 (not shown in FIG. 6) on printhead chassis 250 that is mounted on carriage 200. Carriage motor 380 moves belt 384 to move carriage 200 along carriage guide rail 382. An encoder sensor (not shown) is mounted on carriage 200 and indicates carriage location relative to an encoder fence 383.

Printhead chassis 250 is mounted in carriage 200, and multi-chamber ink supply 262 and single-chamber ink supply 264 are mounted in the printhead chassis 250. The mounting orientation of printhead chassis 250 is rotated relative to the view in FIG. 5, so that the printhead die 251 are located at the bottom side of printhead chassis 250, the droplets of ink being ejected downward onto the recording medium in print region 303 in the view of FIG. 6. Multi-chamber ink supply 262, for example, contains three ink sources: cyan, magenta, and yellow ink; while single-chamber ink supply 264 contains the ink source for black. Paper or other recording medium (sometimes generically referred to as paper or media herein) is loaded along paper load entry direction 302 toward the front of printer chassis 308.

Figure 7:
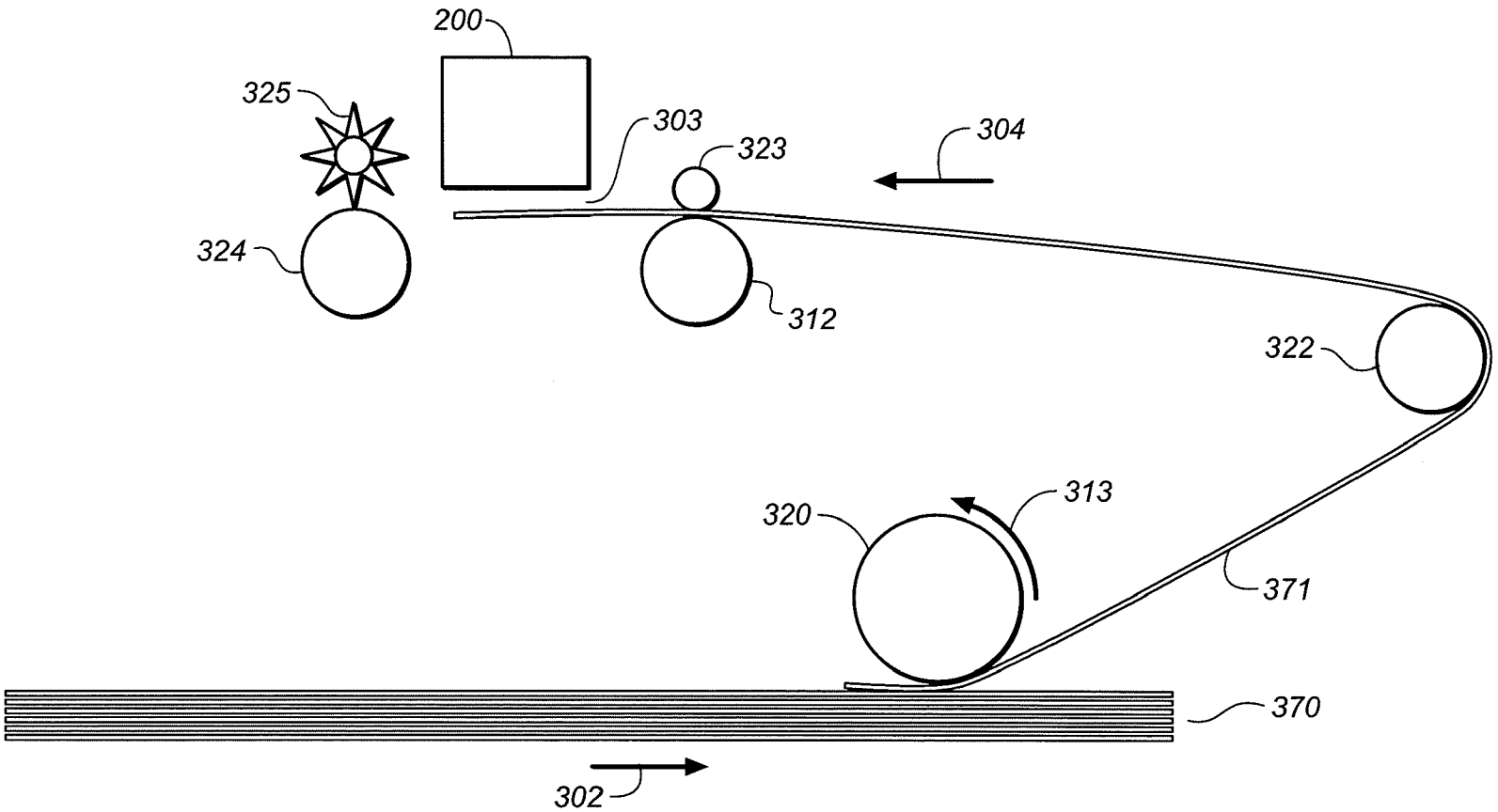
FIG. 7 is a simplified block diagram of the paper flow system of the present invention.

A variety of rollers are used to advance the medium through the printer as shown schematically in the side view of FIG. 7. In this example, a pick-up roller 320 moves the top piece or sheet 371 of a stack 370 of paper or other recording medium in the direction of arrow, paper load entry direction 302. A turn roller 322 acts to move the paper around a C-shaped path (in cooperation with a curved rear wall surface) so that the paper continues to advance along media advance direction 304 from the rear 309 of the printer chassis (with reference also to FIG. 6). The paper is then moved by feed roller 312 and idler roller(s) 323 to advance along the Y axis across print region 303, and from there to a discharge roller 324 and star wheel(s) 325 so that printed paper exits along media advance direction 304. Feed roller 312 includes a feed roller shaft along its axis, and feed roller gear 311 (see FIG. 6) is mounted on the feed roller shaft. Feed roller 312 can include a separate roller mounted on the feed roller shaft, or can include a thin high friction coating on the feed roller shaft. A rotary encoder (not shown) can be coaxially mounted on the feed roller shaft in order to monitor the angular rotation of the feed roller.

The motor that powers the paper advance rollers is not shown in FIG. 6, but the hole 310 at the right side of the printer chassis 306 is where the motor gear (not shown) protrudes through in order to engage feed roller gear 311, as well as the gear for the discharge roller (not shown). For normal paper pick-up and feeding, it is desired that all rollers rotate in forward rotation direction 313. Toward the left side of the printer chassis 307, in the example of FIG. 6, is the maintenance station 330.

Toward the rear of the printer chassis 309, in this example, is located the electronics board 390, which includes cable connectors 392 for communicating via cables (not shown) to the printhead carriage 200 and from there to the printhead chassis 250. Also on the electronics board are typically mounted motor controllers for the carriage motor 380 and for the paper advance motor, a processor and/or other control electronics for controlling the printing process, and an optional connector for a cable to a host computer.

The invention has been described in detail with particular reference to certain preferred embodiments thereof, but it will be understood that variations and modifications can be effected within the spirit and scope of the invention.

PARTS LIST

102 actuator
104 member
106 pressure chamber
108 inlet channel
110 outlet channel
112 sidewall
114 first portion
116 second portion
118 top enclosure
120 inflexible member
122 flexible member

124*a* valve
124*b* valve
126 protruding portion
128 protruding portion
130 inkjet reservoir
132 nozzle
134 micro-fluidic drop ejector
136 ink
138 ink droplet
200 carriage
250 printhead chassis
251 printhead die
253 nozzle array
254 nozzle array direction
255 mounting support member
256 encapsulant
257 flex circuit
258 connector board
262 multi-chamber ink supply
264 single-chamber ink supply
300 printer chassis
302 paper load entry direction
303 print region
304 media advance direction
305 carriage scan direction
306 right side of printer chassis
307 left side of printer chassis
308 front of printer chassis
309 rear of printer chassis
310 hole (for paper advance motor drive gear)
311 feed roller gear
312 feed roller
313 forward rotation direction (of feed roller)
320 pick-up roller
322 turn roller
323 idler roller
324 discharge roller
325 star wheel(s)
330 maintenance station
370 stack of media
371 top piece of medium
380 carriage motor
382 guide rail
383 encoder fence
384 belt
390 electronics board
392 cable connectors

What is claimed is:

1. A printer comprising:

(a) an ink reservoir containing ink and having an outlet through which the ink passes for ejection onto a print medium;

(b) a micro-fluidic actuator comprising:

(i) an inlet channel through which fluid enters;

(ii) a chamber through which the fluid is received from the inlet channel;

(iii) an outlet channel that receives the fluid from the chamber and passes the fluid through the outlet channel so that a conduit pathway for the fluid is formed from the inlet channel, chamber and outlet channel;

(iv) a flexible member that forms a portion of a shared wall between the chamber and the ink reservoir and that displaces in response to fluidic pressure;

(v) at least a first valve in the conduit pathway which, when the valve is activated by being energized, causes flow of the fluid through the conduit pathway to be altered so that pressure of the fluid passing through the chamber changes which, in turn, causes the flexible member to displace which, in turn, causes the ink to be ejected or not ejected from the ink reservoir according to the displacement of the flexible member.

2. The printer as in claim 1, wherein the first valve is disposed on the outlet channel, and activation of the first valve causes the flexible member to displace outwardly away from an interior of the chamber.

3. The printer as in claim 2, wherein partial activation of the first valve causes a first displacement of the flexible member, and full activation of the valve causes a second displacement of the flexible member, the second displacement being larger than the first displacement.

4. The printer as in claim 1, wherein, when the first valve is disposed on the outlet channel, the first valve is not actuated, the flexible member is neither displaced inwardly or outwardly from the interior of the chamber.

5. The printer as in claim 1, wherein the first valve is disposed on the inlet channel and a second valve is disposed on the outlet channel.

6. The printer as in claim 5, wherein, when the first valve is activated, the flexible member is displaced inwardly toward an interior of the chamber.

7. The printer as in claim 6, wherein, the second valve is not activated.

8. The printer as in claim 5, wherein, when the second valve is activated by being energized, the flexible member is displaced outwardly away from an interior of the chamber.

9. The printer as in claim 8, wherein partial activation of the second valve causes a first displacement of the flexible member, and full activation of the second valve causes a second displacement of the flexible member, the second displacement being larger than the first displacement.

10. The printer as in claim 9, wherein the first valve is not activated.

11. The printer as in claim 1, wherein the first valve is disposed on the inlet channel.

12. The printer as in claim 11, wherein partial activation of the first valve causes a first displacement, and full activation of the valve causes a second displacement, the second displacement being larger than the first displacement.

13. The printer as in claim 1, wherein the flexible member with lower elastic modulus produces larger displacement.

14. The printer as in claim 1, wherein the flexible member is made of a dielectric material.

15. The printer as in claim 14, wherein the dielectric material is silicon nitride.

16. The printer as in claim 14, wherein the dielectric material is silicon oxide.

17. The printer as in claim 14, wherein the dielectric material is silicon carbide.

18. The printer as in claim 1, wherein the flexible member is made of silicon.

19. The printer as in claim 1, wherein the flexible member is made of polymer.

20. The printer as in claim 19, wherein the polymer is polyimide.

21. The printer as in claim 1, wherein the flexible member is made of metal or metal alloy.

22. The printer actuator as in claim 21, wherein the metal is Tantalum.

23. The printer as in claim 1, wherein a thickness of the flexible member is less than ⅕ of the minimum width of the flexible member.

24. The printer as in claim 1, wherein the thickness of the flexible member is less than 10 um.

25. The printer as in claim 1, wherein the valve is a piezoelectric actuator.

26. The printer as in claim 1, wherein the valve is a metal bi-morph actuator.

27. The printer as in claim 1, wherein the valve is a metal tri-morph actuator.

28. The printer as in claim 1, wherein the valve is an electrostatic actuator.

29. The printer as in claim 1, wherein the valve includes a heater that boils the liquid to form a vapor bubble to modulate the flow passing through the channel where the valve is located.

30. The printer as in claim 1, wherein the flexible member is corrugated.

31. The printer as in claim 30, wherein the first valve is disposed on the outlet channel, and activation of the first valve causes the flexible member to displace outwardly away from an interior of the chamber.

32. The printer as in claim 31, wherein partial activation of the first valve causes a first displacement of the flexible member, and full activation of the valve causes a second displacement of the flexible member, the second displacement being larger than the first displacement.

33. The printer as in claim 30, wherein, when the first valve is disposed on the outlet channel, the first valve is not actuated, the flexible member is neither displaced inwardly or outwardly from the interior of the chamber.

34. The printer as in claim 30, wherein the first valve is disposed on the inlet channel and a second valve is disposed on the outlet channel.

35. The printer as in claim 34, wherein, when the first valve is activated, the flexible member is displaced inwardly toward an interior of the chamber.

36. The printer as in claim 35, wherein, the second valve is not activated.

37. The printer as in claim 34, wherein, when the second valve is activated, the flexible member is displaced outwardly away from an interior of the chamber.

38. The printer as in claim 37, wherein partial activation of the second valve causes a first displacement of the flexible member, and full activation of the second valve causes a second displacement of the flexible member, the second displacement being larger than the first displacement.

39. The printer as in claim 38, wherein the first valve is not activated.

40. The printer as in claim 30, wherein the first valve is disposed on the inlet channel.

41. The printer as in claim 30, wherein partial activation of the first valve causes a first displacement of the flexible member, and full activation of the valve causes a second displacement of the flexible member, the second displacement being larger than the first displacement.

42. The printer as in claim 30, wherein the flexible member with lower elastic modulus produces larger displacement.

43. The printer as in claim 30, wherein the flexible member is made of a dielectric material.

44. The printer as in claim 43, wherein the dielectric material is silicon nitride.

45. The printer as in claim 43, wherein the dielectric material is silicon oxide.

46. The printer as in claim 43, wherein the dielectric material is silicon carbide.

47. The printer as in claim 30, wherein the flexible member is made of silicon.

48. The printer as in claim 30, wherein the flexible member is made of polymer.

49. The printer as in claim 48, wherein the polymer is polyimide.

50. The printer as in claim 30, wherein the flexible member is made of metal or metal alloy.

51. The printer as in claim 50, wherein the metal is Tantalum.

52. The printer as in claim 30, wherein the thickness of the flexible member is less than ⅕ of the minimum width of the flexible member.

53. The printer as in claim 30, wherein the thickness of the flexible member is less than 10 um.

* * * * *